US007421993B2

(12) United States Patent
Kim

(10) Patent No.: US 7,421,993 B2
(45) Date of Patent: Sep. 9, 2008

(54) VARIABLE VALVE LIFT APPARATUS

(75) Inventor: Hyung Ick Kim, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/648,248

(22) Filed: Dec. 29, 2006

(65) Prior Publication Data

US 2008/0110424 A1 May 15, 2008

(30) Foreign Application Priority Data

Sep. 11, 2006 (KR) ..... 10-2006-0087581

(51) Int. Cl.
*F01L 1/18* (2006.01)

(52) U.S. Cl. ..... 123/90.39; 123/90.12; 123/90.44; 123/90.45; 74/569

(58) Field of Classification Search ..... 123/90.16, 123/90.2, 90.39, 90.44, 90.12, 90.13, 90.41, 123/90.45, 90.48, 90.52, 90.55; 74/559, 74/567, 569

See application file for complete search history.

(56) References Cited

U.S. PATENT DOCUMENTS 2,053,743 A * 9/1936 Russell ..... 123/90.46

* cited by examiner

*Primary Examiner*—Ching Chang
(74) *Attorney, Agent, or Firm*—Peter F. Corless; Edwards Angell Palmer & Dodge LLP

(57) ABSTRACT

A variable valve lift apparatus is provided comprising: an arm; a valve and valve springs connected to a first end of the arm for controlling an air intake and an air exhaust; a driving plunger disposed in a driving plunger groove formed on a second end of the arm which is opposite to the first end; a driving plunger portion elastic member disposed in the driving plunger groove for biasing the driving plunger; a support coupled to a cylinder head for supporting the driving plunger; a locking unit for selectively fixing the driving plunger; and a hydraulic pressure supply unit for selectively supplying hydraulic pressure to the locking unit.

10 Claims, 6 Drawing Sheets

VARIABLE VALVE LIFT APPARATUS

CROSS-REFERENCE TO RELATED APPLICATION

This application claims priority to and the benefit of Korean Patent Application No. 10-2006-0087581 filed in the Korean Intellectual Property Office on Sep. 11, 2006, the entire contents of which are incorporated herein by reference.

BACKGROUND OF THE INVENTION (a) Field of the Invention

The present invention relates to a variable valve lift apparatus. More particularly, the present invention relates to a variable valve lift apparatus that can adjust a valve lift amount in response to an operational state of an engine.

(b) Background

Generally, an automotive engine includes a combustion chamber in which fuel burns to generate power. The combustion chamber is provided with an intake valve for supplying a gas mixture containing the fuel and an exhaust valve for expelling the burned gas. These intake and exhaust valves open and close the combustion chamber by a valve lift apparatus connected to a crankshaft.

A conventional valve lift apparatus use a cam formed in a predetermined shape and provide a fixed amount of valve lift. As a result, it is impossible to adjust the amount of a gas that is being introduced or exhausted. Therefore, the engine cannot run at its optimum state for various driving ranges.

For example, if a valve lift apparatus is designed to optimally respond to a low driving speed, the time for opening valve and the amount of valve lift are not sufficient for a high speed driving state. On the contrary, when the valve lift apparatus is designed to optimally respond to a high speed driving state, an opposite phenomenon occurs in the low speed driving state.

In order to solve the above-described drawback, a variable valve lift apparatus has been researched and developed. A variety of variable lift apparatuses such as a locker arm type variable valve lift apparatus, a direct drive type variable valve lift apparatus, a swing arm type variable valve lift apparatus have been developed.

For example, a conventional high-low cam separation type variable valve lift apparatus has an excellent operational stability and a high degree of design freedom because the low and high cams are separately provided. However, such high-low cam separation type variable valve lift apparatus has a problem in that the driving mass increases and therefore it is not likely to be developed into a cutting-edge technology. In particular, the high-low cam separation type variable valve lift apparatus is not likely to be developed as a continuously variable valve lift.

A conventional swing arm type 2-stable variable valve lift has an inner body for driving a low cam and an outer body for driving a high cam. As a result, it has a drawback in that the driving mass increases and its structural rigidity is deteriorated, making it hard to be used for high speed driving.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a singal cam type variable valve lift apparatus that has a simple structure, a low driving weight and a high structural rigidity.

The present invention also provides a variable valve lift apparatus that can be used as a CDA system through a simple change of design.

An exemplary embodiment of the present invention provides a variable valve lift apparatus, comprising: (a) an arm; (b) a valve and valve springs connected to a first end of the arm for controlling an air intake and an air exhaust; (c) a driving plunger disposed in a driving plunger groove formed on a second end of the arm which is opposite to the first end; (d) a driving plunger portion elastic member disposed in the driving plunger groove for biasing the driving plunger; (e) a support coupled to a cylinder head for supporting the driving plunger; (f) a locking unit for selectively fixing the driving plunger; and (g) a hydraulic pressure supply unit for selectively supplying hydraulic pressure to the locking unit.

Preferably, the locking unit may comprise: a stopper pin disposed in a stopper pin groove formed on the second end of the arm; and a stopper pin portion elastic member disposed in the stopper pin groove for biasing the stopper pin into a stopper pin coupling groove formed on the driving plunger.

Also preferably, the hydraulic pressure supply unit may comprise: an arm hydraulic passage formed in the second end of the arm to connect the stopper pin groove to the driving plunger groove; a support portion hydraulic passage formed so as to penetrate the driving plunger and the support; an oil control valve connected to the support portion passage for selectively supplying oil to the oil control valve; and an engine control unit controlling the oil control valve.

The engine control unit may open and close the oil control valve according to an operational state of an engine.

The stopper pin may be inserted in or removed from the stopper pin coupling groove according to whether the oil control valve is opened or not.

When the stopper pin is inserted in the stopper pin coupling groove, the second end of the arm may not reciprocate in a vertical direction.

When the stopper pin is removed from the stopper pin coupling groove, the second end of the arm may reciprocate in a vertical direction.

The driving plunger portion elastic member may be a compression spring.

The stopper pin portion elastic member may be an extension spring.

The elastic force of the driving plunger portion elastic member may be less than that of the valve spring.

In another aspect, motor vehicles are provided that comprise a described apparatus.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like. The present apparatuses will be particularly useful with a wide variety of motor vehicles.

Other aspects of the invention are discussed infra.

DETAILED DESCRIPTION

An exemplary embodiment of the present invention will hereinafter be described in detail with reference to the accompanying drawings.

An exemplary embodiment of the present invention is described below for a swing arm scheme. However, it is obvious to a person of ordinary skill in the art that the present valve life apparatus may also be applied to a rocker arm scheme. Therefore, it should be understood that the present invention is not limited to the swing arm scheme.

Figure 1:
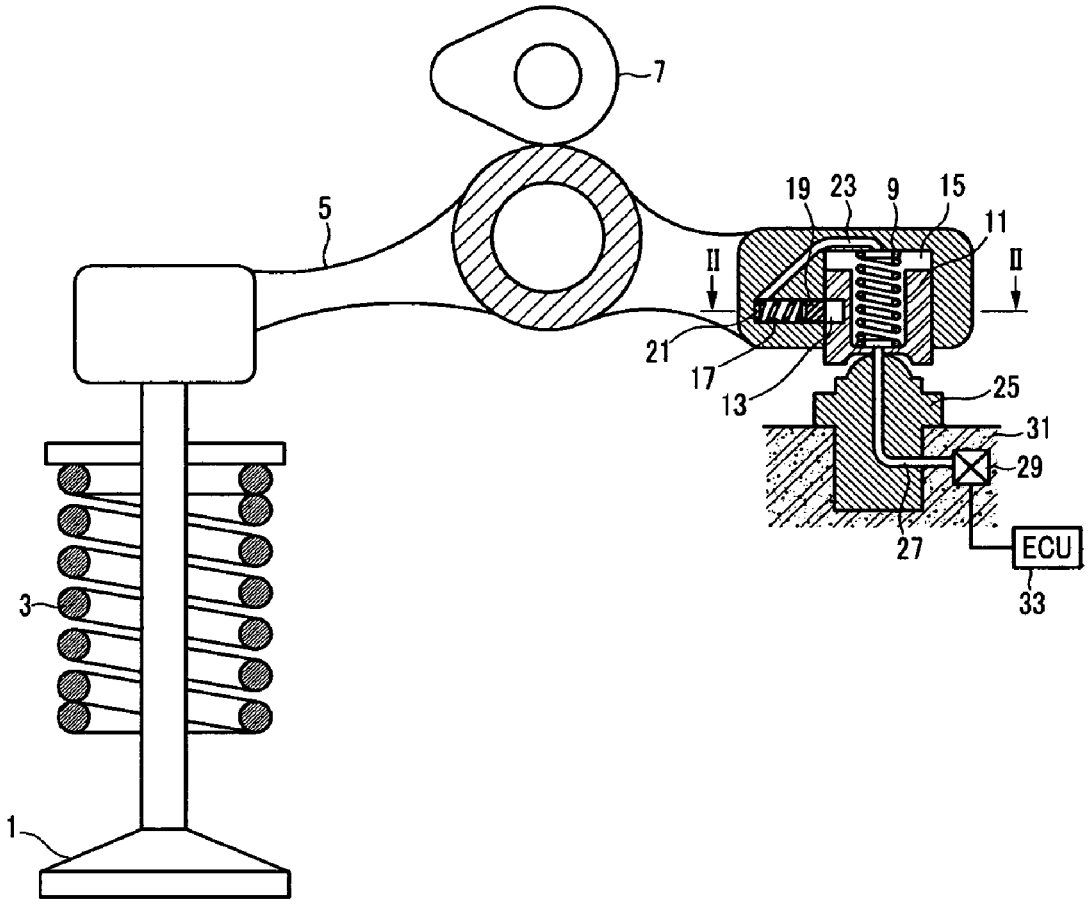
FIG. 1 is a front sectional view of a variable vale lift apparatus according to an exemplary embodiment of the present invention.
Figure 2:
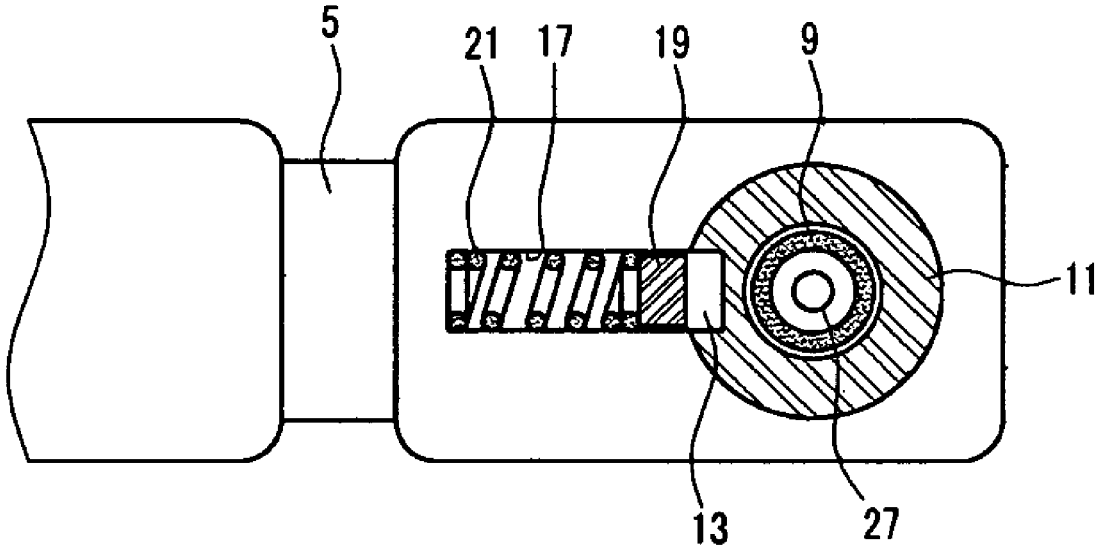
FIG. 2 is a sectional view taken along line II-II of FIG. 2.

FIG. 1 is a front sectional view of a variable valve lift apparatus according to an exemplary embodiment of the present invention and FIG. 2 is a sectional view taken along line II-II of FIG. 2.

As shown in FIG. 1, a valve 1 and a valve spring 3 are connected to one end of a swing arm 5. A driving plunger groove 15 is formed on the other end of the swing arm 5.

A driving plunger 11 is disposed in the driving plunger groove 15. The swing arm 5 reciprocates along an outer circumference of the driving plunger 11.

A driving plunger elastic member 9 is placed in the driving plunger groove 15 to bias the driving plunger 11.

The driving plunger 11 is supported by a support 25 fixed on a cylinder head 31.

The driving plunger 11 is provided with a stopper pin coupling groove 13.

The swing arm 5 is provided with a stopper pin groove 17 corresponding to the stopper pin coupling groove 13.

A stopper pin 19 is disposed in the stopper pin groove 17.

A stopper pin portion elastic member 21 is placed in the stopper pin groove 17 to bias the stopper pin 19.

A hydraulic pressure supply unit supplies hydraulic pressure into the stopper pin groove 17. The hydraulic pressure supply unit includes a swing arm hydraulic passage 23, a support hydraulic passage 27, an oil control valve 29, and an engine control unit 33.

The swing arm hydraulic passage is formed in the swing arm 5 to connect the stopper pin groove 17 to the driving plunger groove 15 so that the oil can be directed to the stopper pin groove 17 through the swing arm passage 23.

The support hydraulic passage 27 is formed through the support 25 and the driving plunger 11 so that the oil can be directed to the driving plunger 15 through the support hydraulic passage 27.

The oil control valve 29 is connected to the support passage 27.

The engine control unit 33 controls the oil control valve according to an operational state of the engine. That is, the oil control valve 29 serves to open and close according to signals from the engine control unit 33.

The elastic force of the driving plunger portion elastic member 9 is less than that of the valve spring 3 so as to prevent the valve 1 from being opened before the oil control valve 29 is opened.

More particularly, when the elastic force of the driving plunger portion elastic member 9 is greater than that of the valve spring 3, the driving plunger portion elastic member 9 is compressed. Thus, valve spring 3 is compressed before an upper portion of the driving plunger 11 contacts an upper portion of the driving plunger groove 15, thereby opening the valve 1 before the oil control valve 29 is opened.

The elastic force of the driving plunger portion elastic member 9 and the elastic force of the valve spring 3 may be determined according to the elastic force of the valve spring 3, a contact location between the swing arm 5 and the cam 7, and a compression displacement of the driving plunger portion elastic member 9.

The driving plunger portion elastic member 9 may preferably be a compression spring.

The stopper pin portion elastic member 21 may preferably be an extension spring.

The following will describe the operation of the variable valve lift apparatus when the oil control valve 29 is opened.

Figure 3:
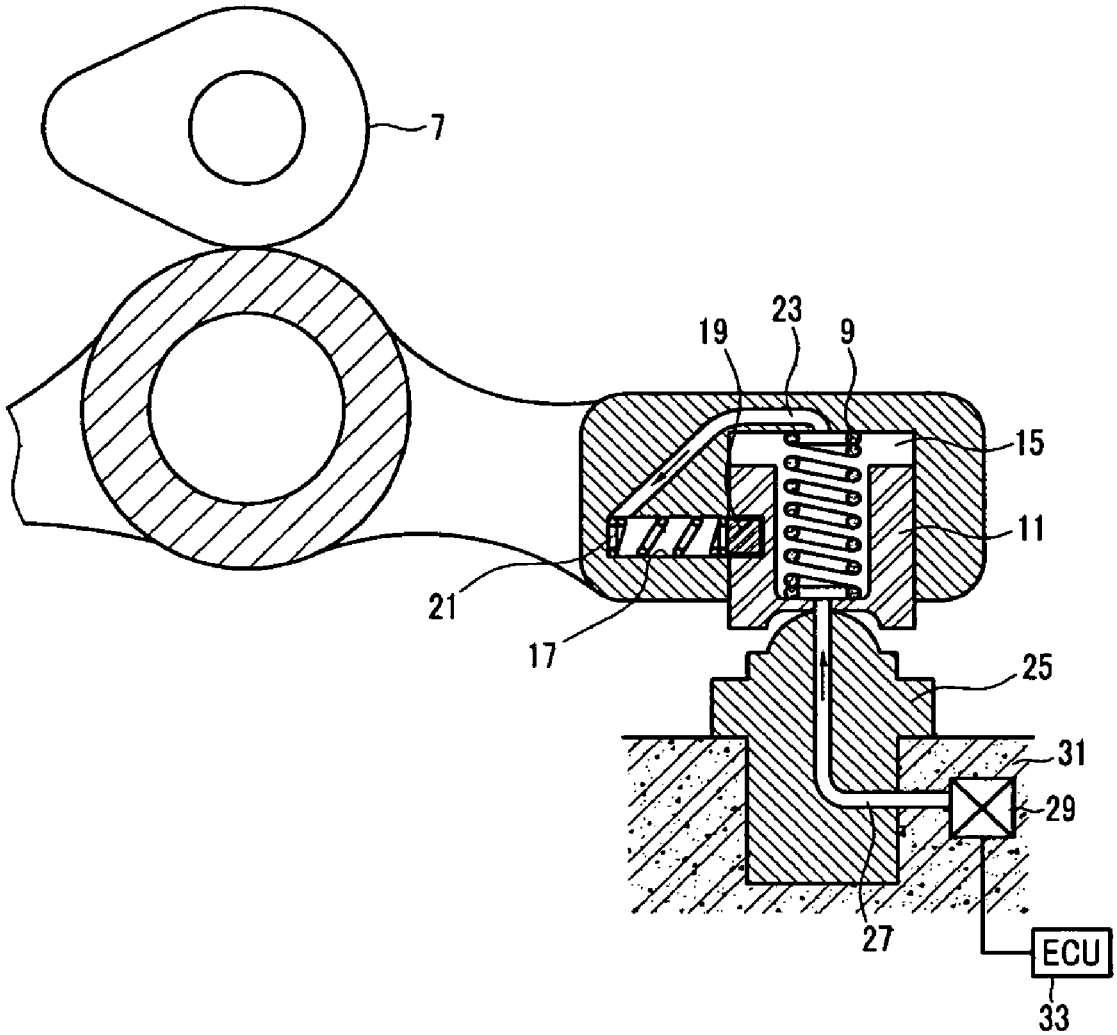
FIG. 3 is a front sectional view illustrating an operational state of the variable valve lift apparatus of FIG. 1 when an oil control valve is open.

FIG. 3 is a front sectional view illustrating an operational state of the variable valve lift apparatus of FIG. 1 when an oil control valve is open.

When the engine is driven at a high speed, as shown in FIG. 3, the oil control valve 29 is opened by the engine control unit. At this point, the oil is directed towards the stopper pin groove 17 through the support hydraulic passage 27, the driving plunger groove 15, and the swing arm hydraulic passage 23. The oil flows in a direction of the arrow in FIG. 3.

When the oil is directed towards the stopper pin groove 17, pressure in the stopper pin groove 17 increases. As a result of the thus-increased pressure, the stopper pin 19 is biased into the stopper pin coupling groove 13 when the stopper pin portion elastic member 21 is pushed into the stopper pin groove 17 (see FIG. 2).

By the insertion of the stopper pin 19 into the stopper pin coupling groove 13, the swing arm 5 operates as a conventional swing arm. That is, a portion of the swing arm 5, at which the driving plunger 11 is placed, does not reciprocate even when the cam 7 rotates. A portion of the swing arm 5, at which the valve 1 is disposed, reciprocates.

The following will describe the operation of the variable valve lift apparatus when the oil control valve 29 is closed.

Figure 4:
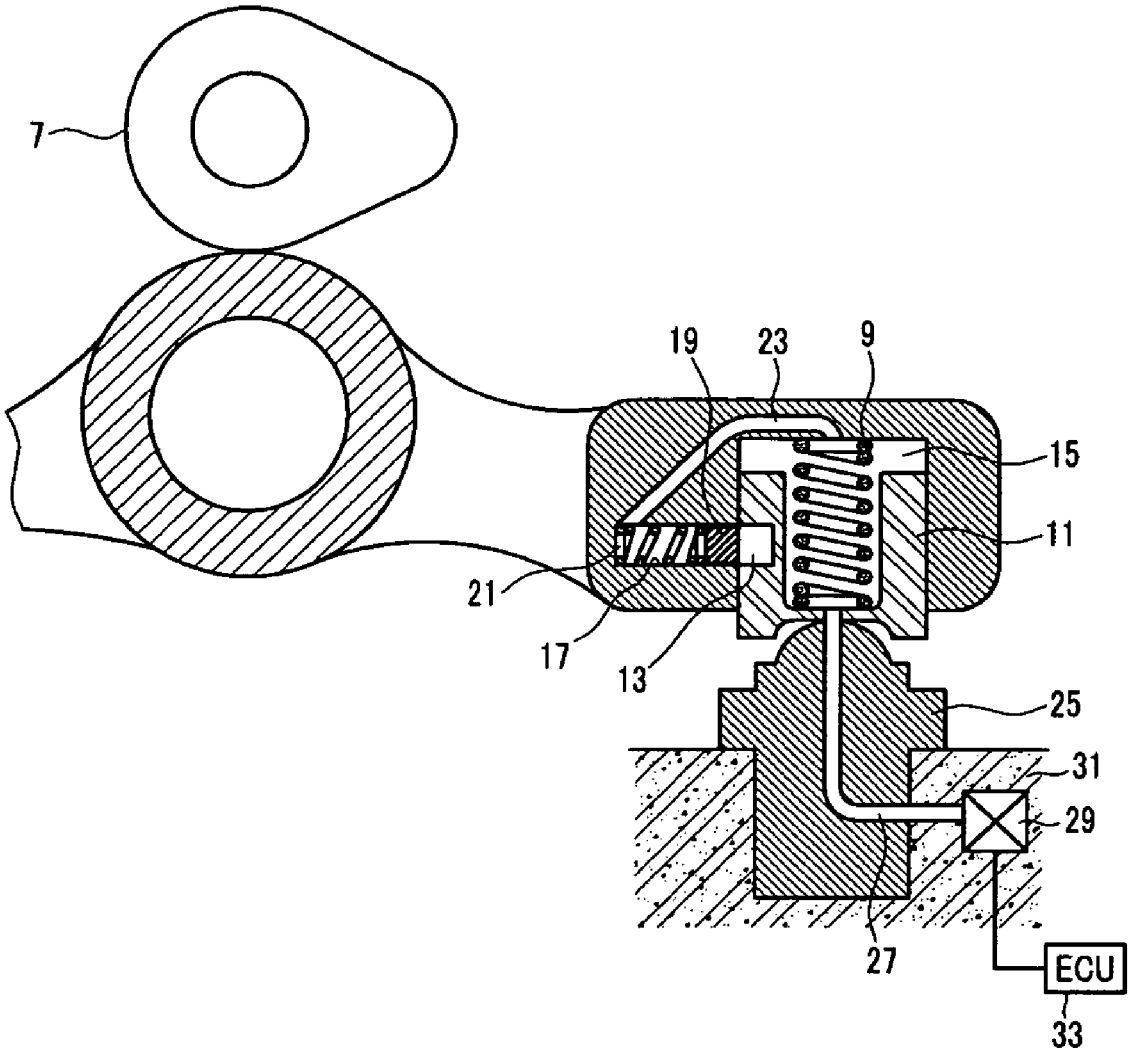
FIGS. 4 through 6 are front sectional views illustrating an operational state of the variable valve lift apparatus of FIG. 1 when an oil control valve is closed.
Figure 5:
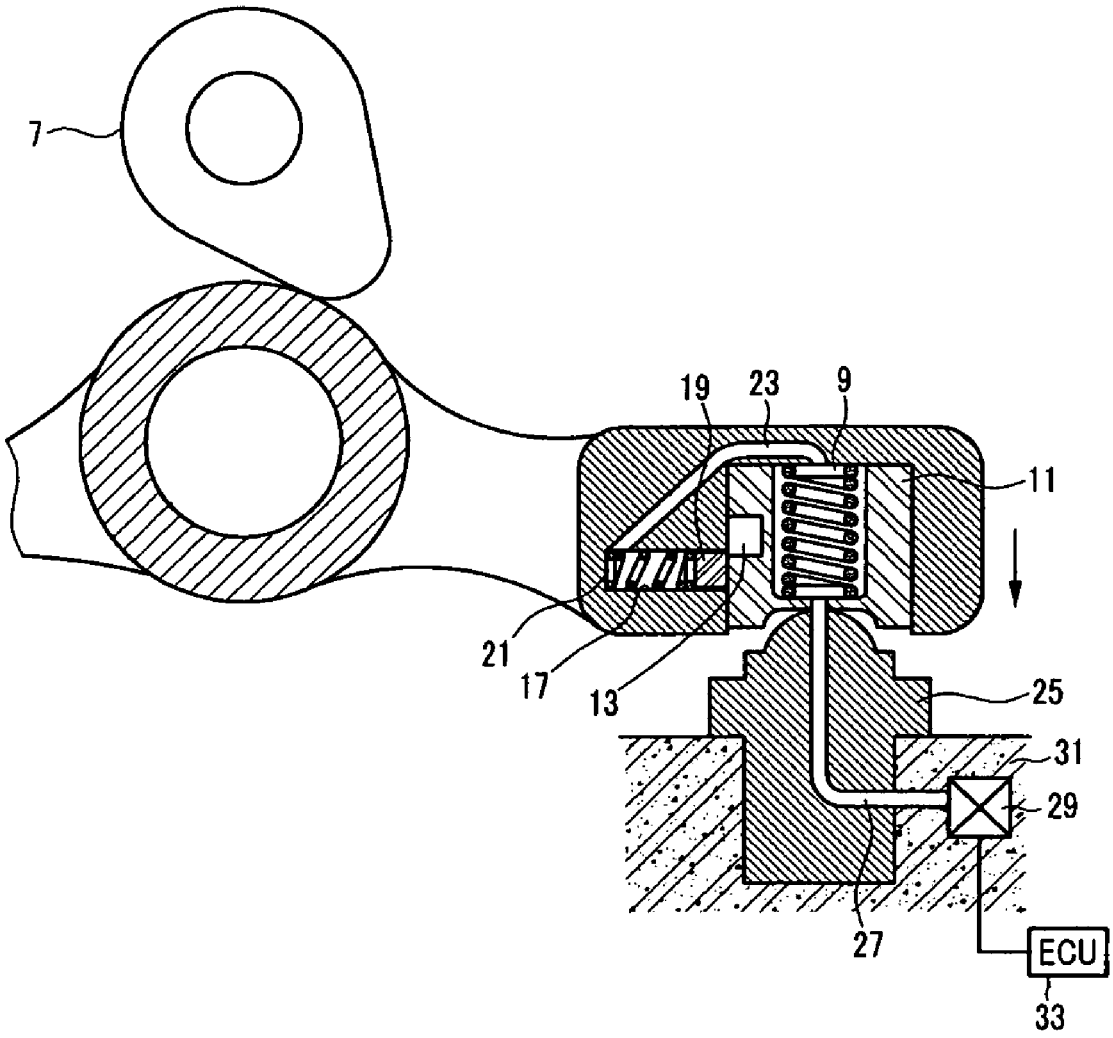
Figure 6:
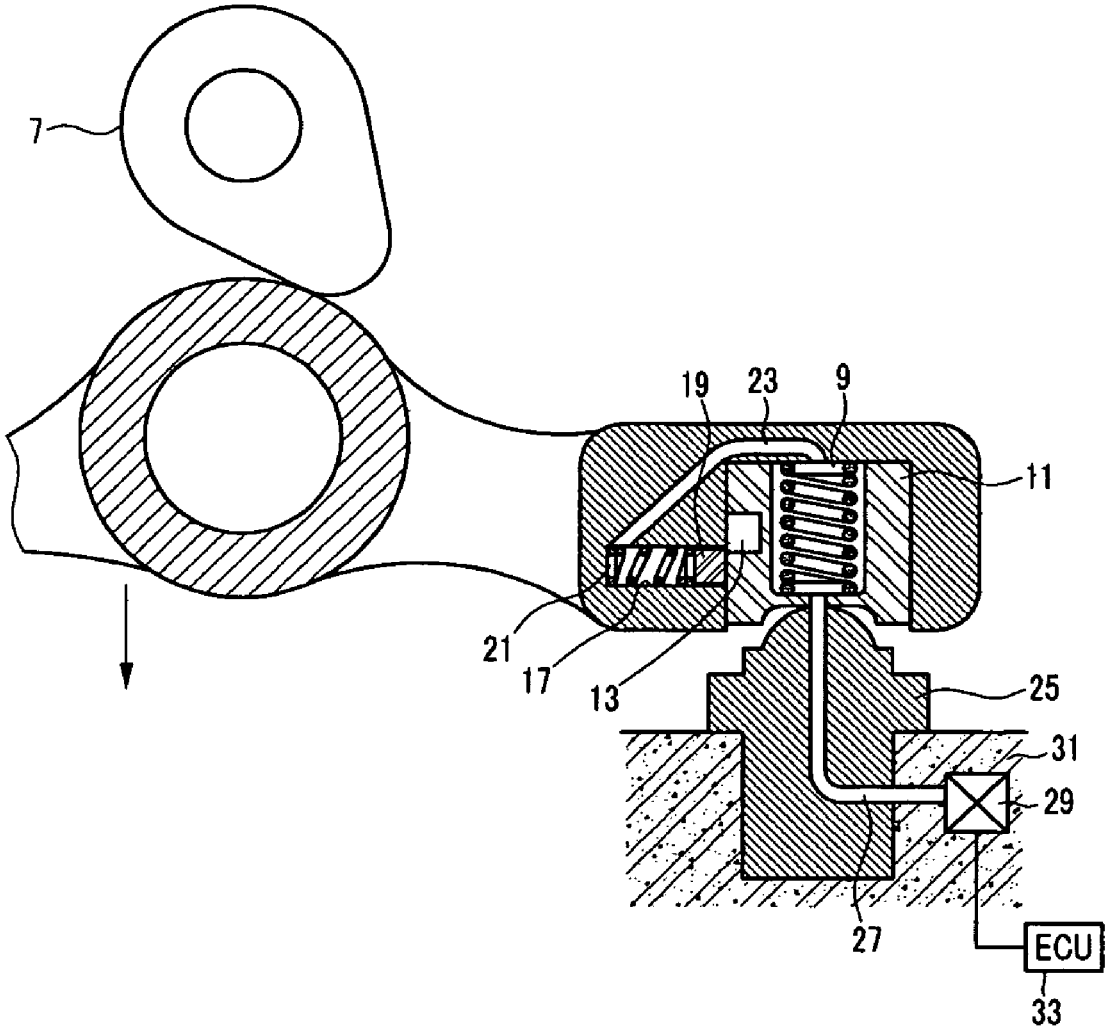

FIGS. 4 through 6 are front sectional views illustrating an operational state of the variable valve lift apparatus of FIG. 1 when an oil control valve is closed.

When the engine is driven at a low speed, as shown in FIG. 4, the oil control valve 29 is closed by the engine control unit 33. At this point, the hydraulic pressure is released from the stopper pin groove 17 and thus the stopper pin 19 moves out of the stopper pin coupling groove 13 in the driving plunger 11 by the elastic force of the stopper pin portion elastic member 21.

When the cam 7 rotates, as shown in FIG. 5, a force for pressing the swing arm 5 is generated by the cam 7. At this point, the driving plunger portion elastic member 9 is compressed until the upper portion of the driving plunger groove 15 contacts the upper portion of the driving plunger 11. As shown in FIG. 5, a portion of the swing arm 7 moves in the direction of the arrow.

In this case, a longitudinal end of the swing arm 5 where the valve 1 is disposed becomes a rotational center and the valve 1 is not opened until the upper portion of the driving plunger groove 15 contacts the upper portion of the driving plunger 11.

As shown in FIG. 6, when the upper portion of the driving plunger groove 15 contacts the upper portion of the driving plunger 11, the rotational motion of the portion of the swing arm 5, at which the driving plunger 11 is placed, stops. From this point, the portion of the swing arm, at which the valve 1 is disposed, rotates to open the valve 1.

That is, swing arm 5, at which the valve 1 is disposed, moves in the direction of the arrow as shown in FIG. 6.

At this point, a portion where the driving plunger 11 contacts the support 25 becomes the rotational center.

After this, although not shown in the drawings, the valve 1 is closed again as the cam 7 rotates and then the portion of the swing arm 5, at which the plunger 11 is placed, is returned to its initial state.

Subsequently, the above-described operation is repeated.

An operational state where the intake and exhaust valves are not opened or closed even when the cam rotates is called a lost motion of the driving plunger. A difference between minimum and maximum distances between the upper portion of the driving plunger 11 and the upper portion of the plunger groove 15 is called a lost motion distance of the driving plunger.

When the oil control valve 29 is closed, the valve 1 has a shorter duration and a less lifting amount than when the oil control valve 29 is open. That is, as described above, since the lost motion of the driving plunger is generated by the variable valve lift apparatus, the opening and closing durations and the opening and closing amounts of the valve 1 are reduced in proportion to the lost motion distance of the driving plunger.

When increasing the lost motion distance of the driving plunger, it can be applied to a swing arm apparatus for a cylinder de-activation (CDA).

Although a variable valve lift apparatus having two lifts is described above, a system having an operational state of a general engine and an operational state where the valve is not opened and closed can be realized by adjusting the lost motion of the driving plunger of the present embodiment.

When the CDA system is applied to a multi-cylinder engine, some of the cylinders have an operational state where no power is generated and thus fuel consumption can be reduced.

As described above, according to the present invention, since the valve lift can be variably adjusted according to an engine speed, the engine efficiency can be significantly improved and the fuel consumption ratio and engine output can be improved. Furthermore, when the lift distance of the driving plunger is adjusted, the variable valve lift apparatus of the present invention can be used as the CDA system.

Furthermore, since the variable valve apparatus of the present invention is designed to have a single cam structure, the structure thereof is simpler than that of the conventional variable valve apparatus with low and high cams that are separated, thereby providing a higher degree of design freedom. In addition, the variable valve lift apparatus can be made having an enhanced structural rigidity and a relatively low driving weight.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A variable valve lift apparatus, comprising:

an arm;

a valve and valve springs connected to a first end of the arm for controlling an air intake and an air exhaust;

a driving plunger disposed in a driving plunger groove formed on a second end of the arm which is opposite to the first end;

a driving plunger portion elastic member disposed in the driving plunger groove for biasing the driving plunger;

a support coupled to a cylinder head for supporting the driving plunger;

a locking unit for selectively fixing the driving plunger; and a hydraulic pressure supply unit for selectively supplying hydraulic pressure to the locking units, wherein the locking unit comprises:

a stopper pin disposed in a stopper pin groove formed on the second end of the arm; and a stopper pin portion elastic member disposed in the stopper pin groove for biasing the stopper pin into a stopper pin coupling groove formed on the driving plunger.

2. The variable valve lift apparatus of claim 1, wherein the hydraulic pressure supply unit comprises:

an arm hydraulic passage formed in the second end of the arm to connect the stopper pin groove to the driving plunger groove;

a support portion hydraulic passage formed so as to penetrate the driving plunger and the support;

an oil control valve connected to the support portion passage for selectively supplying oil to the oil control valve; and an engine control unit controlling the oil control valve.

3. The variable valve lift apparatus of claim 2, wherein the engine control unit opens and closes the oil control valve according to an operational state of an engine.

4. The variable valve lift apparatus of claim 3, wherein the stopper pin is inserted in or removed from the stopper pin coupling groove according to whether the oil control valve is opened or not.

5. The variable valve lift apparatus of claim 4, wherein when the stopper pin is inserted in the stopper pin coupling groove, the second end of the arm does not reciprocate in a vertical direction.

6. The variable valve lift apparatus of claim 4, wherein when the stopper pin is removed from the stopper pin coupling groove, the second end of the arm reciprocates in a vertical direction.

7. The variable valve lift apparatus of claim 1, wherein the stopper pin portion elastic member is an extension spring.

8. The variable valve lift apparatus of claim 1, wherein the driving plunger portion elastic member is a compression spring.

9. The variable valve lift apparatus of claim 8, wherein an elastic force of the driving plunger portion elastic member is less than that of the valve spring.

10. A motor vehicle comprising the variable valve lift apparatus of claim 1.

* * * * *